US005746609A

United States Patent [19]

Franks, Jr.

[11] Patent Number: 5,746,609

[45] Date of Patent: May 5, 1998

[54] CLAMPING BRACKET FOR A GROUNDING SYSTEM

[76] Inventor: George J. Franks, Jr., 664 Thompson Cir., Inverness, Ill. 60067

[21] Appl. No.: 777,839

[22] Filed: Dec. 26, 1996

[51] Int. Cl.[6] ..... H01R 4/66

[52] U.S. Cl. ..... 439/92; 439/443; 439/803

[58] Field of Search ..... 439/92, 4.43, 803, 439/813

[56] References Cited

U.S. PATENT DOCUMENTS

| | | | |
|---|---|---|---|
| 4,322,773 | 3/1982 | Bordner . | |
| 4,828,504 | 5/1989 | Franks, Jr. | 439/92 |
| 4,884,976 | 12/1989 | Franks, Jr. | 439/92 |
| 4,993,960 | 2/1991 | Franks, Jr. | 439/92 |
| 5,006,074 | 4/1991 | Franks, Jr. | 439/92 |
| 5,114,354 | 5/1992 | Franks, Jr. | 439/92 |

OTHER PUBLICATIONS

Sachs bonding connectors SC51-1, SC51-2, SC51-3 and application procedures 1992.

Sachs bonding connector SC51-CF 1995.

*Primary Examiner*—Gary F. Paumen

*Attorney, Agent, or Firm*—Ronald L. Wanke; Jenner & Block

[57] ABSTRACT

A clamping bracket connects an electrical wire to a lip of a grounded utility box so as to ground the wire. The bracket has U-shaped portions and a threaded stud which advances an annular abrading end surface with a center cone point into engagement with the lip when located between the U-shaped portions. The rear planar member of the U-shape is formed by a leaf spring which slants inwardly. The front planar member of the U-shape has side ribs which strengths the front planar member and space a threaded bore from the lip.

17 Claims, 1 Drawing Sheet

CLAMPING BRACKET FOR A GROUNDING SYSTEM

FIELD OF THE INVENTION

The present invention relates to a clamping bracket for mechanical and electrical connection to a metal plate, and has particular utility for connecting a grounded metal utility box to an electrical wire which is to be grounded through the utility box.

BACKGROUND OF THE INVENTION

Various clamping devices are known for providing an electrical and mechanical connection from an electrical wire to a metal plate such as a utility box which is separately connected to ground. For example, the utility meter box for an electrical power system, a telephone interface utility box, and a cable television (CATV) box may each be grounded by an elongated ground rod sunk into the ground and connected through heavy gauge wire to the utility box. Typical utility boxes are painted and/or treated with a coating to prevent rusting and to provide a long term life. Drilling a hole through a metal wall of the utility box is highly undesirable in that it may allow foreign matter and moisture into the box, can create a safety problem due to high voltage, can allow corrosion of the metal, and/or may be contrary to local codes.

Numerous clamping devices have been devised to connect a grounded utility box to a separate electrical conductor which is to be grounded so as to eliminate the need for an additional grounding system. Examples of such clamping devices are shown in U.S. Pat. Nos. 4,993,960 and 5,006,074 of the present applicant. Each of these patents show elongated clamps which span a metal utility box which is grounded in order to mechanically and electrically connect the utility box to an electrical wire coupled to other devices which are to be electrically grounded such as a telephone system, a cable TV system or the like. In certain situations, the elongated clamps which span across a utility box are not usable such as when several utility boxes are ganged together or are flush mounted panels. In addition, it is desirable to provide a clamping bracket which is less expensive to manufacture and has utility for a variety of grounding purposes.

Several U-shaped clamping devices, corner brackets and the like are known which are secured to a lip or corner of a utility box in order to couple an electrical wire to the grounded utility box. Generally, such prior art devices have consisted of one or more screws which clamp the device to the utility box, and an additional screw which couples the device to an electrical wire which is to be grounded through the utility box. Typical prior art devices of this type suffer from a variety of problems which have prevented more widespread use. As one or more screws on the device are tightened against a lip or corner of a utility box, continuing tightening can cause the device to "walk" or move across the utility box, causing difficulty in forming an adequate connection. Also, such devices can tilt or skew during tightening of multiple screws.

Because of various code requirements, there should be a separate screw for connecting an electrical wire to the clamping bracket in addition to any clamping screw(s) for connecting the bracket to the utility box. The one or more clamping screws for connecting the bracket to the utility box are tightened first. Then, an electrical wire is connected to the separate screw which is then tightened. This tightening of the separate screw can cause undesirable movement and/or loosening of the clamping screw(s) which have connected the device to the utility box.

Other U-shaped clamping devices are known for securing an electrical wire to a metal plate for grounding purposes or the like. For example, U.S. Pat. Nos. 4,828,504 and 4,884,976 of the present applicant each show U-shaped clamps which can connect an electrical wire through a threaded stud having an abrading annular end surface to a metal plate. However, the thickness of the uprights forming the U-shaped clamp prevents the use of such a device when limited space is available. For example, a utility box may include a lip which overhangs a wall and only a narrow space is available for the clamping bracket. Such a narrow space will allow only a thin metal piece to be inserted into the gap to serve as a brace for the bracket.

Because of adverse weather conditions, it is very important for the clamping device to be rugged, as well as capable of forming and maintaining over time a secure mechanical and electrical connection to the utility box. In addition, the clamping device should be inexpensively formed with minimum parts and be capable of simple installation. This combination of features has not been satisfactorily solved in prior clamping devices.

SUMMARY OF THE INVENTION

A unique clamping bracket is provided which is readily connectable to an overhanging lip of a utility box to provide a more secure connection than has been possible with a utility box having a limited and restricted clamping area. The clamping bracket has minimum parts and is capable of a simple installation. It minimizes undesired "walking" or movement of the clamping device while it is being secured. Furthermore, the separate connection of an electrical wire to the clamping bracket does not tend to loosen the bracket from its clamping connection to the utility box.

In accordance with one aspect of the invention, the clamping bracket is formed by generally U-shaped members which converge slightly towards each other and exhibit a spring action. The slanted clamping surfaces are resiliently deflectable relative to each other as tightening occurs of a threaded stud. The bracket is readily connectable to a lip of a utility box where there is minimum space between the lip and the utility box wall, and yet provides a relatively strong connection.

In accordance with another aspect of the invention, a rectangular plate is bent to form a generally U-shaped bracket for connection to a lip of a utility box. Side ribs extend rearwardly from the front plate to space the front surface containing a threaded bore a small distance away from the lip of the utility box. A single threaded stud extends through the threaded bore and is rotatable to advance into engagement with the lip for strong mechanical and electrical connection therewith. The side ribs create flanges which strengthen the bracket and allow sufficient torque on the threaded stud to penetrate the outer surface of the lip to form an adequate grounding connection.

In addition, the simplicity of the bracket and its ease of attachment create a clamping device for a utility box having a very limited contacting area for the clamp. It can be attached readily by persons having no special training and without the need for special tools. The resulting unique clamping bracket is usable in a variety of grounding situations which have not previously been addressed in an adequate manner.

DETAILED DESCRIPTION OF A PREFERRED EMBODIMENT

Figure 1:
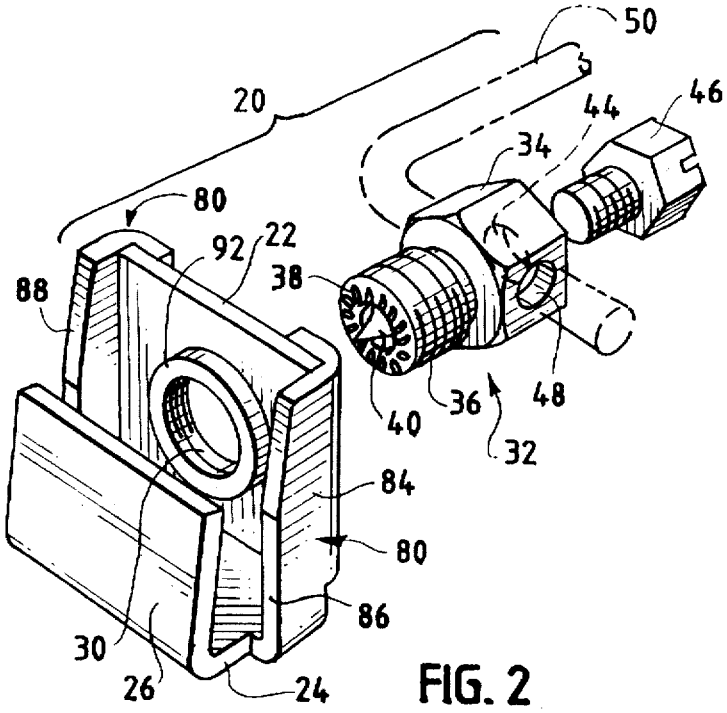
FIG. 1 is a perspective and exploded view of the novel clamping bracket.

Referring to FIG. 1, a novel clamping bracket 20 includes a generally rectangular metal plate which is bent into three sections to form a generally U-shaped member in which one side of the U is of greater length than the other side. Namely, the first longer section or side consists of a front planar member 22 which extends vertically upright from a second section of the general U-shape consisting of a base member 24 located at the bight or bottom of the U. A third shorter section consists of a rear or brace planar member 26 extending generally upwardly from the base member 24. The front and rear sections 22 and 26 are not parallel but incline together as will be explained. In the center of the front planar member 22, a threaded bore 30 extends axially through the front planar member and is located opposite the top edge region of the brace member 26. Preferably, the center axis of the bore 30 is located near the top region of the rear member 26, so that the rear member 26 extends slightly above the center axis.

The bracket 20 also includes a threaded stud or bolt 32 which has a hexagonal-shaped head 34 integrally formed on the bolt. The enlarged head 34 narrows to a threaded neck 36 which terminates in an abrading annular end surface 38. A center cone or point 40 extends outwardly from the center of the end surface of the neck 36. Center point 40 is generally cone-shaped and extends a short length past the end surface 38, as is described later in more detail.

The annular end 38 forms an abrading surface created by spaced grooves and ridges. Other penetrating end surfaces are usable including scoring or cutting or knife-like edges formed in the end of the neck. As will appear, the annular surface 38 is designed abrade the surface of the metal utility box so as to penetrate any paint or other coating or corrosion on the outside surface in order to form a secure mechanical as well as electrical connection with the utility box. The center point 40 serves to prevent inadvertent movement or "walking" of the bracket as it is being secured, as will be explained later.

Enlarged head 34 of the threaded bolt includes a threaded bore 44 coaxial with axis of the threaded neck 36 and receives a threaded securing screw 46 which can be axially threaded into the bore 44. The head 34 also includes a cross bore 48 which extends through the head 34 and perpendicularly intersects the threaded bore 44. The cross bore 48 receives an electrical conductor or wire 50, shown in dashed lines, which can be inserted into the cross bore 48 when it is to be electrically coupled to the utility box in order to ground the wire 50.

Figure 4:
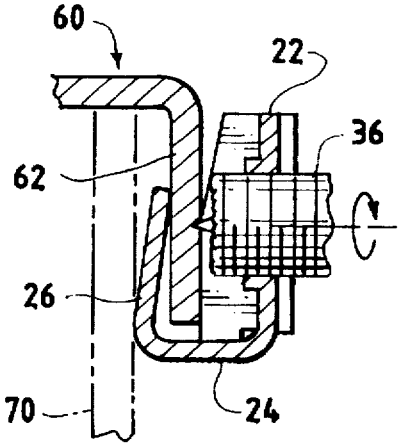
FIG. 4 is a side plan view, partly in section, of the clamping bracket including the threaded stud when engaging a lip of a utility box, and illustrating in dashed lines the clearance problem involved with other utility boxes.
Figure 5:
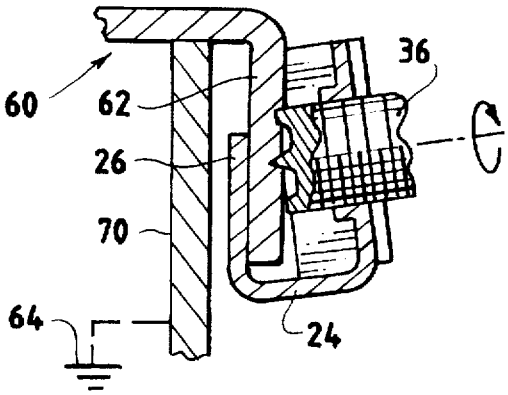
FIG. 5 is a side plan view, partly in section, of the clamping bracket including the threaded stud when engaging a lip of another utility box having minimal clearance between the lip and a wall, and illustrating a skewed manner of initial attachment of the clamping bracket to the utility box.
Figure 6:
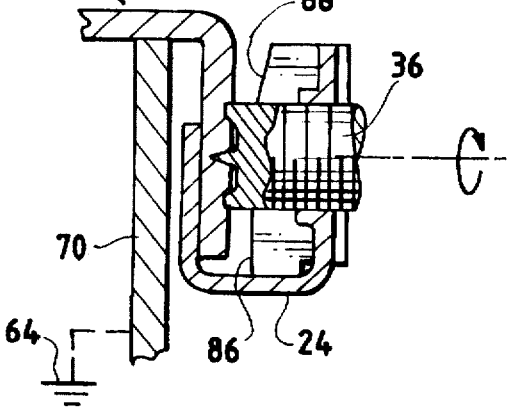
FIG. 6 is a side plan view, partly in section, of the bracket and utility box portions seen in FIG. 5 and the manner in which spring action changes the orientation of the clamping bracket during tightening onto the lip of the utility box.

Two variations of the utility box 60 are illustrated in FIG. 4 and FIGS. 5–6. Typically, an extending metal plate, such as a lip or skirt 62, extends from the utility box and provides a suitable surface for connecting the clamp bracket 20 to the utility box. Typically, the utility box itself is coupled to ground 64, as is illustrated in FIGS. 5 and 6, by means of a ground rod which is sunk into the ground and is coupled through a heavy electrical wire to the metal utility box. Examples of some grounded utility boxes are illustrated in my U.S. Pat. Nos. 4,993,960 and 5,006,074, the disclosures of which are hereby incorporated by reference herein. Such utility boxes can form an electrical power meter box, and/or a telephone interface box. In addition, the utility box can be in the form a flush mounted panel which is recessed into a building wall. Such utility boxes are typically painted or have other coatings covering the box for protection. Also, it is common for dirt and/or corrosion to form on the outside surfaces of the utility box. The clamping bracket 20 needs to form both a mechanical and a electrical connection to the metal interior of the utility box lip 62. This electrical connection can be for the purpose of connecting a telephone interface box in order to an electrical power box to avoid the necessity for another ground rod. Alternatively, the electrical wire 50 maybe coupled to a cable TV system which is to be grounded to a telephone utility box or to an electrical power utility box.

To form the connection, the bracket is inserted over the lip 62 of the utility box so that the generally U-shaped space defined by the members 22, 24 and 26 surround the lip 62, as seen in FIGS. 4 and 5. Then, the threaded bolt 32 is rotated within the threaded bore 30 so as to advance the neck end surface into abutment with the lip 62. The projecting point 40 will penetrate the outer surface of the lip 62 in order to prevent inadvertent movement or "walking" of the bracket 20 as it is being secured. As rotation of the bolt 32 continues such as with a wrench over the head 34, the abrading end surface 38 grinds through the coating or paint of the outer surface of the utility box lip and into intimate electrical and mechanical connection with the lip.

After the threaded bolt 34 is thus secured, the electrical conductor wire 50 is inserted into the cross bore 48. Then, the securing screw 46 is tightened into the threaded bore 44 to snugly engage the electrical wire 50. Because the threaded bore 44 is coaxial with the threaded bore 30, continued rotation of the securing screw 46 continues to tighten the bolt 32 against the lip 62, and thus prevents inadvertent loosening of the connection.

Many utility boxes have a lip 62 which closely overhangs a wall and this can greatly restrict the space available for connection of the bracket. For example, a wall 70, seen in dashed lines in FIG. 4, is often located closely adjacent the lip 62 and provides a very narrow and restricted gap between the lip 62 and the wall 70. This wall 70 can interfere with the brace member 26 as is illustrated in FIG. 4. The clamping bracket 20 is construed in a manner which allow the bracket to be utilized in such restricted spaces, such as are illustrated in FIGS. 5 and 6.

Figure 3:
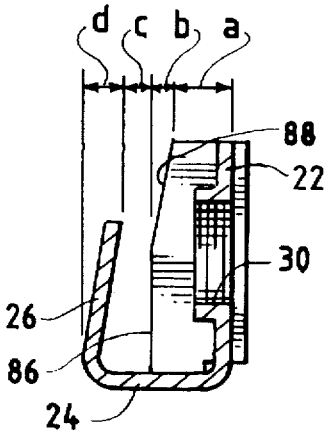
FIG. 3 is a side sectional view of the portion of the bracket of FIG. 2 taken along lines 3—3.

More particularly, the front planar member 22 and the brace planar member 26 slant towards each other as can be seen in FIG. 3. Thus, the planes of the planar members 22 and 26 are inclined toward each other and would intersect when projected upwardly. As a result, the axial distance between members 22 and 26 is shorter at the top opening of the U shape and is wider at the bottom of the bight adjacent the base member 24.

In a preferred form, the brace planar member 26 is a leaf spring which is resiliently movable. When pressure is applied, it will deflect rearwardly and open or widen the top opening. As a result, the rear brace planar member 26 will move to a position generally parallel with the front planar member 22, as seen in FIG. 6. To create the leaf spring, the rectangular plate which is bent into the three sections 22, 24 and 26 is formed of CR spring steel material such as SAE 1074 which is heat treated to a hardness of 46 Rockwell C of suitable thickness, such as 0.048 inches thickness.

Figure 2:
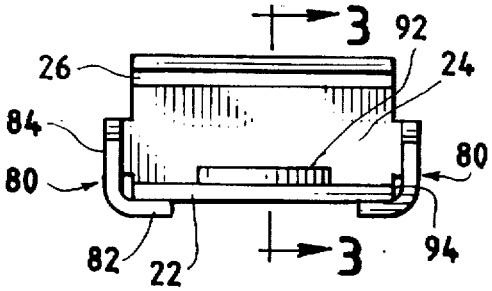
FIG. 2 is a top plan view of a portion of the clamping bracket shown in FIG. 1.

The front planar member 22 should remain rigid, however. A pair of side ribs or flanges 80 are spaced apart and located along each side of the front planar member 22, as seen in FIGS. 1–3. Each side rib 22 is formed by a generally L-shaped flange having a front portion 82 extending in front of the planar surface 22, and a side rib 84 which extends rearwardly a greater distance than the thickness of the front planar member 22 and the threaded bore 30. The bottom of the flanges are welded to the base member 24. Each side rib 80 extends rearwardly to an edge rib surface 86 which is parallel to the front planar surface 22. At a transition point adjacent the top opening of the generally U-shaped member, the rear edge tapers into an angled edge 88 which is inclined at an angle to vertical. The axis of the angled edge 88 is generally parallel to the axis of the inwardly inclined brace planar surface 26, as can be seen in FIG. 3.

By way of example, the dimensions for one bracket 20 which was constructed are as follows. The overall vertical height of the bracket was about 0.826 inches. The approximate vertical height of the rear brace member 26 was about 0.5 inches. Certain depth dimensions labeled a, b, c and d are illustrated in FIG. 3. Depth a represents the distance from the front planar member 22 to the corner at which the angled edge 88 meets the top of the flange, and is on the order of 0.197 inches. The depth b is the maximum distance that the angled rear edge 88 is cut away from the vertical plane of the vertical rear edge 86 when projected upwardly, and is on the order of 0.062 inches. Thus, the distance a plus b from the front surface of the planar member 22 to the vertical rear edge 86 is on the order of 0.259 inches. The depth c extends from that point to the inside terminating end of the brace planar member 26 and is about 0.097 inches. Thus, an approximately 1/10th inch gap in the axial direction exists at the top opening of the generally U-shaped space. The distance d extends from that point to the rear of the brace planar member and is about 0.230 inches. In FIG. 3, the inward slope of the rear spring leaf 26 can be seen with respect to these vertical reference lines. Of course, these dimensions are representative only and are not limiting.

The thin material forming the front planar member 22, having a dimension such as 0.048 inches, can cause insufficient threaded surface in the bore 30 to adequately grip the threaded bolt 32 so as to allow adequate torque for tightening the bolt against the lip 62. The front member 22 can be extruded to create an annular extension 92 before the threads are formed in the bore in order to increase the depth of threaded surface area. The extension can have a thickness such as 0.062 inches, so that the total axial depth of the bore 30 is on the order of 0.1 inches. This dimension is substantially less than the axial depth of the side ribs 84. Alternatively, the extension 92 could be formed by a washer welded to the rear of the front planar member 22.

When the meter box rib 62 abuts the rear vertical edges 86, as seen in FIG. 4, the pair of side ribs space the lip 62 a distance or gap away from the threaded bore 30. As the threaded bolt 32 is rotated within the threaded bore 30, the bolt advances through the front planar member 22 and 92, spans the gap created by the pair of side ribs 80, and then comes into contact with the utility box lip 62. The initial contact is either by the center cone 40 when the meter box has no obstructing wall, as seen in FIG. 4, or by a combination of the center cone 40 and an upper region of the annular abrading surface 38, as seen in FIG. 5 as will be explained below.

Each side rib 80 consists of an L-shaped section in which the front section 82 is located in front of the front planar member 22. As the threaded bolt is rotated and advanced into abutment, the utility box lip 62 presses against the brace member 26 which presents resistance to the threaded bolt. The threaded bolt 32 urged urges forwardly the front planar member 22. The front abutting surfaces 82 of the pair of side flanges 80 restrain forward movement of planar member 22 and serve to strengthen the overall U-shaped bracket. To further support the front planar member 22 against forward deflection, and increase the rigidly of the overall structure, the front planar member 22 can be soldered or welded 94 to the side ribs 80. The resulting bracket is very rigid while minimalizing the thickness of the plate material used in forming the bracket.

When the utility box lip 62 has minimal spacing in front of a wall 70, as seen in FIGS. 5 and 6, the bracket 20 cannot be inserted in the gap between the lip 62 and wall 70 while oriented in a vertical direction for the front planar member because of the lack of clearance. In this situation, the bracket 20 is initially tilted as shown in FIG. 5 and slips upwardly against the inner surface of lip 62. In this tilted orientation, the angled edge 88 is in sliding abutment with the outer vertical surface of the lip 62. As a result, the bracket can be inserted into a narrow gap in which the lip is just slightly spaced from the wall 70, and the gap is only slightly larger than the thickness of the brace member 26. In this titled orientation of FIG. 5, the center point 40 preferably contacts the lip 62 at the same time that the upper portion of the annular abrading surface 38 contacts the lip 62. As the threaded neck 36 is rotated, the threaded bolt simultaneously digs into the lip 62 at the position of the center point and the upper abrading edge 38. The center point prevents "walking" of the bracket as the upper annular abrading rim 38 simultaneously digs into the lip 62. While use of the point 40 is advantageous, it can be eliminated to reduce the cost of making the threaded bolt, although some "walking" is liable to occur in certain situations.

As the threaded neck 36 continues to be rotated, more area of the annular abrading rim 38 will be pressed into the lip 62. Also, the brace member 26 will deflect rearwardly and the bracket will assume a more vertical orientation until reaching the position illustrated in FIG. 6. Continued rotation of the threaded bolt will cause the entire annular abraded rim 38 to dig partly into the lip 62.

The angled rib edges 88 in effect represent "cut out" surfaces with respect to the vertical plane of the rib edges 86. This allows the bracket to be tilted against the lip 62 as seen in FIGS. 5. If the edges 68 were extended vertically to the top corner, then the top side of the side ribs would interfere with the tilting of the bracket when initially inserted over the lip 62. Thus, an increased angle of tilt is available.

Various modifications can be made without departing from the advantageous features of the present invention. For example, while the resilient connection between the front planar member 22 and the rear brace planer member 26 was accomplished by making the rear brace a flexible leaf spring, it will be apparent that the rear brace could be rigid with the front planar member 22 being flexible. Also, the rear brace member 26 could form a right angle with the bottom member 24, and the front planar member 22 could be slanted from vertical. Other modifications are within the spirit of the present invention.

What is claimed is:

1. A clamping bracket for mechanical and electrical connection to a metal plate, comprising:

a front planar member having a threaded bore extending axially therethrough, a base member extending rearwardly from the front planar member, a brace planar member extending upwardly from the base member to create therebetween a generally U-shaped space for containing the metal plate, the planar members being slanted towards each other so that the axial distance between the front planar member and the brace planar member is closer at a top opening and wider at a bottom adjacent the base member, at least certain ones of the members being resiliently movable to increase the axial distance of the top opening, a threaded stud which engages the threaded bore and is rotatable to axially advance an abrading end surface of the stud into engagement with the metal plate and cause resilient movement of the certain ones of the members to thereby increase the axial distance at the top opening as the threaded stud is advanced to clamp the bracket to the metal plate, the abrading end surface of the threaded stud penetrating the outer surface of the metal plate to thereby electrically connect the metal plate to the bracket.

2. The clamping bracket of claim 1 wherein the brace planar member is formed by a spring leaf which extends upwardly from the base member, the spring leaf being bendable rearwardly as the threaded stud is advanced to urge the metal plate against the spring leaf.

3. The clamping bracket of claim 2 including rib means extending between the front planar member and the base member to form a rigid connection therebetween while allowing the brace planar member to bend rearwardly.

4. The clamping bracket of claim 2 wherein the front planar member, the base member and the brace planar member are formed from a single rectangular plate of spring material which is bent at angles to create a generally U-shape bracket.

5. The clamping bracket of claim 1 wherein the brace planar member extends upwardly a shorter distance than the extent of the front planar member with the brace planar member terminating in a region axially opposite the threaded bore.

6. The clamping bracket of claim 1 wherein the abrading end surface is formed by an annular rim, and a center point projects from the end of the threaded stud and above the surrounding annular rim.

7. The clamping bracket of claim 6 wherein a plane extending between the center point and the annular rim is generally parallel to the plane of the brace planar member.

8. The clamping bracket of claim 1 wherein the threaded stud has a head region opposite the abrading end surface, a threaded head bore located in the head and coaxial with the threaded stud, and screw means located within the threaded head bore for connecting an electrical conductor to the threaded stud.

9. The clamping bracket of claim 8 wherein there is only a single threaded bore in the front planar member and the threaded stud is the sole element which is movable from the front planar member into engagement with the metal plate.

10. A clamping bracket for mechanical and electrical connection to a metal plate, comprising:

a generally U-shaped plate having a front planar member containing a threaded bore, a base member at a bight section, and a rear planar member to create between the front and rear planar members a generally U-shaped space for containing the metal plate, a pair of side ribs spaced on the front planar surface and each extending rearwardly to an edge rib surface which abuts the metal plate when located within the generally U-shaped space, the pair of edge rib surfaces spacing the threaded bore of the front planar member away from the metal plate to create a gap therebetween, and a threaded stud rotatably movable within the threaded bore to move an abrading end surface of the stud axially through the gap and into engagement with the metal plate to urge the metal plate against the rear planar surface, the abrading end surface penetrating the outer surface of the metal plate to thereby electrically connect the threaded stud to the metal plate.

11. The clamping bracket of claim 10 wherein the pair of side ribs each comprise a generally L-shaped flange having a rear section extending to the edge rib surface and a front section at a generally perpendicular angle to the rear section, and the front section being located in abutment with the front planar member.

12. The clamping bracket of claim 11 wherein the front section of the flange is located in front of the front planar member to stiffen the front planar member against forward deflection as the threaded stud engages the metal plate.

13. The clamping bracket of claim 11 wherein the rear planar member is at a slant to the plane of the front planar member, and the rear section of each flange includes an angled surface generally parallel to the rear planar member.

14. The clamping bracket of claim 10 wherein the front and brace planar members are resiliently movable with respect to each other.

15. The clamping bracket of claim 10 wherein the brace planar member is formed by a spring leaf which is bendable as the threaded stud is advanced to urge the metal plate against the spring leaf.

16. The clamping bracket of claim 10 including screw means for connecting an electrical conductor to the bracket.

17. The clamping bracket of claim 16 wherein the threaded stud includes a head opposite the abrading end surface, the screw means includes a securing threaded bore in the head for receiving the electrical conductor therein, and a securing screw located within the securing threaded bore for clamping the electrical conductor within the head.

* * * * *